US006467290B2

(12) United States Patent
Minowa et al.

(10) Patent No.: US 6,467,290 B2
(45) Date of Patent: Oct. 22, 2002

(54) THERMAL EXPANSION VALVE

(75) Inventors: Masakatsu Minowa, Tokyo (JP); Kazuhiko Watanabe, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/925,708

(22) Filed: Aug. 10, 2001

(65) Prior Publication Data

US 2002/0023461 A1 Feb. 28, 2002

(30) Foreign Application Priority Data

Aug. 10, 2000 (JP) ..... 2000-242272

(51) Int. Cl.[7] ..... F25B 41/04
(52) U.S. Cl. ..... 62/225; 236/92 B
(58) Field of Search ..... 62/225; 236/92 B, 236/99 D

(56) References Cited

U.S. PATENT DOCUMENTS 5,228,619 A * 7/1993 Yano et al. ..... 236/92 B
5,297,728 A * 3/1994 Yano et al. ..... 236/92 B
5,361,597 A * 11/1994 Hazime et al. ..... 236/92 B
6,223,994 B1 * 5/2001 Fukuda et al. ..... 236/92 B

* cited by examiner

*Primary Examiner*—William E. Tapolcai
*Assistant Examiner*—Mohammad M. Ali
(74) *Attorney, Agent, or Firm*—Rader, Fishman & Grauer PLLC

(57) ABSTRACT

A heat transmission retardant member 140 which is a cylinder-shaped resin tube made of nylon or polyacetals is mounted between an adsorbent 40 and an inner wall of a hollow portion of a heat-sensing driven member 100 with a space 140' between said inner wall. The hollow portion of said heat-sensing driven member 100 includes said adsorbent 40, said heat transmission retardant member 140 made of resin, and said space 140'. Said heat transmission retardant member 140 comprises plural protrusions, and by positioning said protrusions to contact said inner wall, said space 140' is formed. Since said space 140' is formed between said inner wall of the hollow portion of said heat-sensing driven member 100 and said heat transmission retardant member 140, not only is the heat transmission to the granular activated carbon delayed by the heat transmission retardant member, but said space also effectively delays the transmission of the temperature variation of the refrigerant to the heat transmission retardant member. Thus, hunting of the valve is even further effectively suppressed.

7 Claims, 5 Drawing Sheets

PRIOR ART

PRIOR ART

THERMAL EXPANSION VALVE

FIELD OF THE INVENTION

The present invention relates to a thermal expansion valve used in a refrigeration cycle.

DESCRIPTION OF THE RELATED ART

Conventionally, a thermal expansion valve shown in FIG. 5 is used in a refrigeration cycle in order to control the flow rate of the refrigerant being supplied to an evaporator and to decompress the refrigerant.

In FIG. 5, a prism-shaped aluminum valve body 510 comprises a first refrigerant passage 514 including an orifice 516, and a second refrigerant passage 519, the two passeges formed mutually independent from one another. One end of the first refrigerant passage 514 is communicated to the entrance of an evaporator 515, and the exit of the evaporator 515 is communicated through the second refrigerant passage 519, a compressor 511, a condenser 512 and a receiver 513 to the other end of the first refrigerant passage 514. A bias means 517 which is a bias spring biasing a sphere-shaped valve means 518 is formed to a valve chamber 524 communicated to the first refrigerant passage 514, and the valve means 518 is driven toward or away from the orifice 516. Further, the valve chamber 524 is sealed by a plug 525, and the valve means 518 is biased through a support member 526. A power element 520 including a diaphragm 522 is fixed to the valve body 510 adjacent to the second refrigerant passage 519. An upper chamber 520*a* in the power element 520 defined by the diaphragm 522 is maintained airtight, and is filled with temperature-corresponding working fluid.

A small pipe 521 extending out from the upper chamber 520*a* of the power element 520 is used to degasify the upper chamber 520*a* and to fill the temperature-corresponding working fluid to the upper chamber 520*a*, before the end of the pipe is sealed. The extended end of a valve drive member 523 functioning as the heat-sensing/transmitting member positioned within the valve body 510 extending from the valve means 518 and penetrating through the second refrigerant passage 519 is positioned in the lower chamber 520*b* of the power element 520, contacting the diaphragm 522. The valve drive member 523 is made of a material having a large thermal capacity, and it transmits the temperature of the refrigerant vapor exiting the evaporator 515 and flowing through the second refrigerant passage 519 to the temperature-corresponding working fluid filling the upper chamber 520*a* of the power element 520, which generates a working gas having a pressure corresponding to the transmitted temperature. The lower chamber 520*b* is communicated to the second refrigerant passage 519 through the space formed around the valve drive member 523 within the valve body 510.

Accordingly, the diaphragm 522 of the power element 520 uses the valve drive member 523 to adjust the valve opening of the valve means 518 against the orifice 516 (that is, the amount of flow of liquid-phase refrigerant entering the evaporator) according to the difference in pressure of the working gas of the temperature-corresponding working fluid filling the upper chamber 520*a* and the pressure of the refrigerant vapor exiting the evaporator 515 in the lower chamber 520*b*, under the influence of the biasing force of the bias means 517 provided to the valve means 518.

According to the above-mentioned prior-art thermal expansion valve, the power element 520 is exposed to external atmosphere, and the temperature-corresponding driving fluid in the upper chamber 520*a* receives influence not only from the temperature of the refrigerant exiting the evaporator and transmitted by the valve drive member 423 but also from the external atmosphere, especially the engine room temperature. Moreover, the above conventional valve structure often causes a so-called hunting phenomenon where the valve responds too sensitively to the refrigerant temperature at the exit of the evaporator and repeats the opening and closing movement of the valve means 518. The hunting phenomenon is caused for example by the structure of the evaporator, the way the pipes of the refrigeration cycle are positioned, the way the expansion valve is used, and the balance with the heat load.

Conventionally, a time constant retardant such as an absorbent or a thermal ballast is utilized to suppress such hunting phenomenon. FIG. 6 is a cross-sectional view showing the conventional thermal expansion valve utilizing an activated carbon as an adsorbent, the structure of which is basically similar to the prior-art thermal expansion valve of FIG. 5, except for the structure of the diaphragm and the structure of the valve drive member that functions as a heat-sensing driven member. According to FIG. 6, the thermal expansion valve comprises a prism-shaped valve body 50, and the valve body 50 comprises a port 52 through which the liquid-phase refrigerant flowing through a condenser 512 and entering from a receiver tank 513 travels into a first passage 62, a port 58 sending the refrigerant traveling through the first passage 62 out toward an evaporator 515, an entrance port 60 of a second passage 63 through which the gas-phase refrigerant exiting the evaporator returns, and an exit port 64 through which the refrigerant exits toward the compressor 511.

The port 52 through which the refrigerant is introduced is communicated to a valve chamber 54 positioned on the center axis of the valve body 50, and the valve chamber 54 is sealed by a nut-type plug 130. The valve chamber 54 is communicated through an orifice 78 to a port 58 through which the refrigerant exits toward the evaporator, 515. A sphere-shaped valve means 120 is mounted to the end of a small-diameter shaft 114 that penetrates the orifice 78, and the valve means 120 is supported by a support member 122. The support member 122 biases the valve means 120 toward the orifice 78 using a bias spring 124. The area of the flow path for the refrigerant is adjusted by varying the gap formed between the valve means 120 and the orifice 78. The refrigerant sent out from the receiver 514 expands while passing through the orifice 78, and travels through the first passage 62 and exits from the port 58 toward the evaporator. The refrigerant exiting the evaporator enters from the port 60, and travels through the second passage 63 and exits from the port 64 toward the compressor.

The valve body 50 is equipped with a first hole 70 formed from the upper end portion along the axis, and a power element portion 80 is mounted to the first hole using a screw portion and the like. The power element portion 80 includes housings 81 and 91 that constitute the heat sensing portion, and a diaphragm 82 that is sandwiched between these housings and fixed thereto through welding. The upper end portion of a heat-sensing driven member 100 made of stainless steel or aluminum is welded onto a round hole or opening formed to the center area of the diaphragm 82 together with a diaphragm support member 82'. The diaphragm support member 82' is supported by the housing 81.

An inert gas is filled inside the housing 81, 91 as a temperature-corresponding working fluid, which is sealed thereto by the small tube 21. Further, a plug body welded to the housing 91 can be used instead of the small tube 21. The diaphragm 82 divides the space within the housing 81, 91 forming an upper chamber 83 and a lower chamber 85.

The heat-sensing driven member 100 is formed of a hollow pipe-like member exposed to the second passage 63, with activated carbon 40 stored to the interior thereof. The upper end of the heat-sensing/pressure transmitting member 100 is communicated to the upper chamber 83, defining a pressure space 83*a* by the upper chamber 83 and the hollow portion 84 of the heat-sensing driven member 100. The pipe-like heat-sensing driven member 100 penetrates through a second hole 72 formed along the axis of the valve body 50, and is inserted to a third hole 74. A gap is formed between the second hole 72 and the heat-sensing driven member 100, through which the refrigerant in the passage 63 is introduced to the lower chamber 85 of the diaphragm.

The heat-sensing driven member 100 is slidably inserted to the third hole 74, and the end thereof is connected to one end of the shaft 114. The shaft 114 is slidably inserted to a fourth hole 76 formed to the valve body 50, and the other end thereof is connected to the valve means 120.

According to this structure, the adsorbent 40 functioning as a time constant retardant works as follows. When a granular activated carbon is used as the adsorbent 40, the combination of the temperature-corresponding working fluid and the adsorbent 40 is an absorption-equilibrium type, where the pressure can be approximated by a linear expression of the temperature within a considerably wide temperature range, and the coefficient of the linear expression can be set freely according to the amount of granular activated carbon used as the adsorbent. Therefore, the character of the thermal expansion valve can be set at will.

Accordingly, it takes a relatively long time to set the adsorption-equilibrium-type pressure-temperature equilibrium state when the temperature of the refrigerant vapor flowing out from the exit of the evaporator 515 is either rising or falling. In other words, by increasing the time constant, the work efficiency of the air conditioning device is improved, stabilizing the performance of the air conditioning device capable of suppressing the sensitive operation of the thermal expansion valve caused by the influence of disturbance which may lead to the hunting phenomenon.

SUMMARY OF THE INVENTION

However, the hunting phenomenon differs according to the characteristic of each individual refrigeration cycle. Especially when a fine temperature variation occurs to the low-pressure refrigerant exiting the evaporator, the small fluctuation or pulsation of the refrigerant temperature is transmitted directly to the opening/closing movement of the valve means, which causes unstable valve movement, and the use of a thermal ballast material or an adsorbent can no longer suppress hunting.

Therefore, the present invention aims at providing a thermal expansion valve that is capable of controlling stably the amount of low-pressure refrigerant sent out toward the evaporator, and that enables to further suppress the hunting phenomenon by providing,an appropriate delay to the response of the valve to temperature change, even when small temperature variation occurs to the low-pressure refrigerant transmitted from the evaporator. This is realized without changing the basic design of the conventional thermal expansion valve, maintaining the conventional operation of the valve.

In order to achieve the above objects, the present invention provides a thermal expansion valve including a refrigerant passage extending from an evaporator to a compressor, and a heat-sensing driven member with a hollow portion formed to the interior thereof and having a heat sensing function positioned within the refrigerant passage: wherein the end of the hollow portion of the heat-sensing,driven member is fixed to the center opening portion of a diaphragm constituting a power element portion that drives the driven member, thereby communicating the hollow portion with an upper pressure chamber defined by the diaphragm within the power element portion and forming a sealed space filled with working fluid; and a heat transmission retardant member is placed between a time constant retardant stored within the hollow portion and the inner wall of the hollow portion so that a space is formed between the inner wall and the heat transmission retardant member.

In a preferred embodiment, the heat transmission member is cylindrical.

According to the thermal expansion valve of the present invention having a structure as explained above, a member that delays heat transmission is placed between the inner wall of the hollow portion of the heat-sensing driven member and the time constant retardants stored within the hollow portion. According to this structure, heat transmission from the heat-sensing driven member to the time constant retardant is delayed, and the time constant is increased compared to the valve where only a time constant retardant is used. In addition thereto, since a space is formed between the heat-sensing driven member and the heat transmission retardant member, the change in refrigerant temperature is transmitted with even further delay to the heat transmission retardant member. As a result, the present invention suppresses hunting of the valve member in a thermal expansion valve more effectively.

Further, the cylindrical member has protrusions formed thereto, and by contacting the protrusions to the inner wall, the space is formed between the inner wall and the cylindrical member that delays the heat transmission.

In another embodiment, the cylindrical member is formed to have a polygonal shape, the corners of which contact the inner wall so as to form the space. The present embodiment enables to form a space between the inner wall and the cylindrical member easily, and to provide further delay to the heat transmission to the heat transmission retardant member.

Moreover, the cylindrical heat transmission retardant member is preferably formed using resin material, which has sufficiently low thermal conductivity compared to stainless steel or aluminum, that is mounted between the time constant retardant and the inner wall of the hollow portion of the heat-sensing driven member.

DETAILED DESCRIPTION OF PREFERRED EMBODIMENTS

Now, an embodiment of the present invention will be explained with reference to the drawings.

Figure 1:
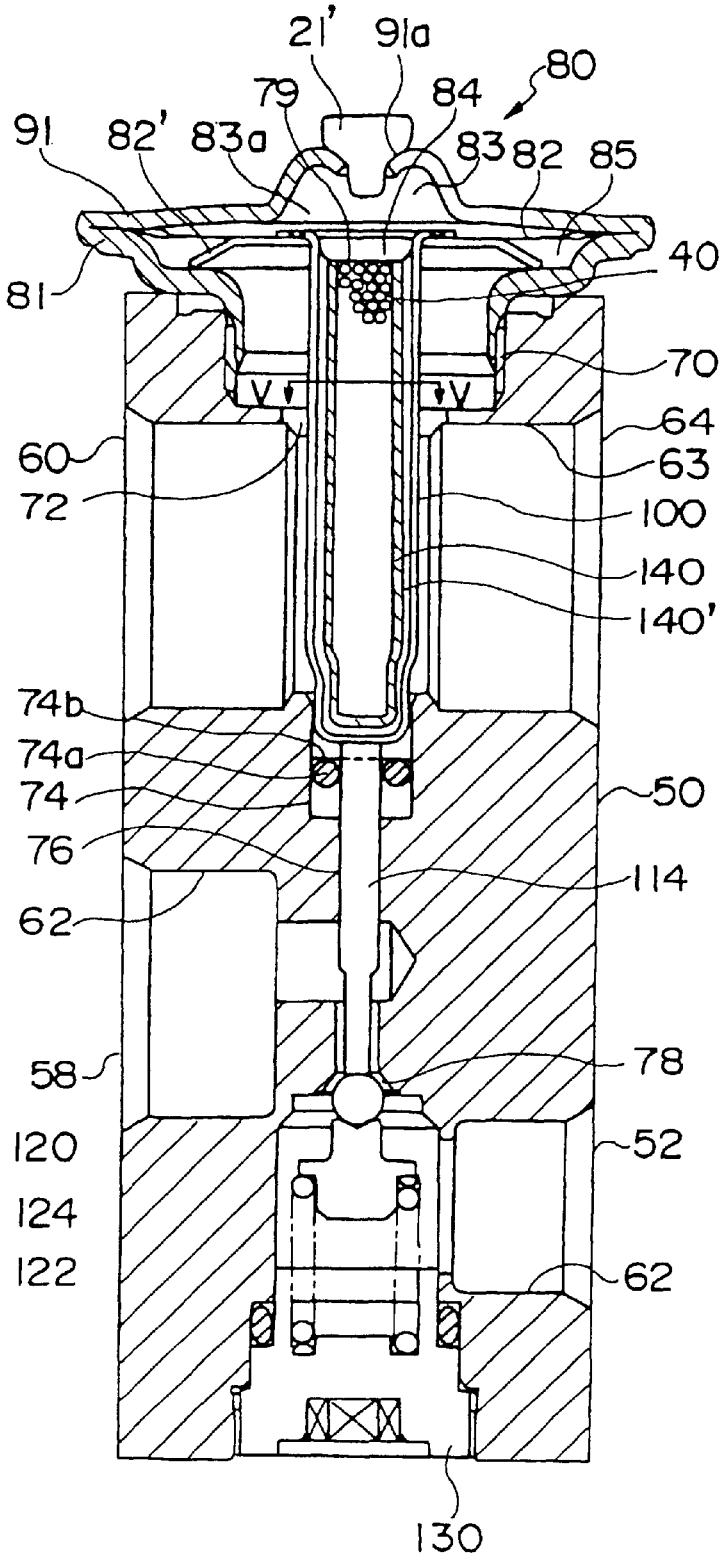
FIG. 1 is a vertical cross-sectional view showing one embodiment of the thermal expansion valve according to the present invention.
Figure 2:
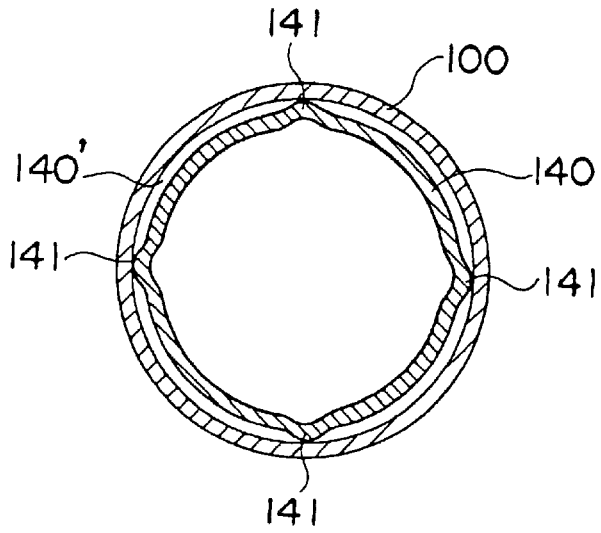
FIG. 2 is a cross-sectional view taken at line V—V of the thermal expansion valve shown in FIG. 1.

FIG. 1 and FIG. 2 are vertical cross-sectional views showing one embodiment of the thermal expansion valve according to the present invention, and FIGS. 3(A) and (B) show another embodiment of the main portion thereof. The basic structure of the embodiment of FIG. 11 is similar to that of the conventional thermal expansion valve, so only the areas that differ are explained here, and the equivalent portions are provided with the same reference numbers as those of the prior art valve, the detailed explanations thereof being omitted.

In FIG. 1, reference number 140 refers to a heat transmission retardant member made of resin and the like, and in this embodiment, it is a cylindrical resin tube made of nylon or polyacetals, which is mounted between the activated carbon 40 and the inner wall of the hollow portion of the heat-sensing driven member 100, with a space 140' between the inner wall. Therefore, the hollow portion of the heat-sensing driven member 100 is equipped with an adsorbent 40, a heat-transmission retardant member 140 made of resin material, and space 140'.

The above-mentioned space 140' is formed as shown in FIG. 2. FIG. 2 is a cross-sectional view taken at line V—V of FIG. 1 showing the cylindrical heat transmission retardant member 140 and the heat-sensing driven member 100. The heat transmission retardant member 140 is provided with plural protrusions 141 (four in the drawing), and the space 140' is formed by positioning the protrusions to contact the inner wall of the member 100.

Since according to the present embodiment a space 140' is formed between the heat transmission retardant member 140 and the inner wall of the hollow portion of the heat-sensing driven member 100, in addition to the delay in temperature transmission to the granular activated carton from the heat transmission retardant member, the existence of the space further enables to delay the transmission of refrigerant temperature variation to the heat transmission retardant member. Thus, the hunting of the valve means is even further effectively suppressed.

Figure 3:
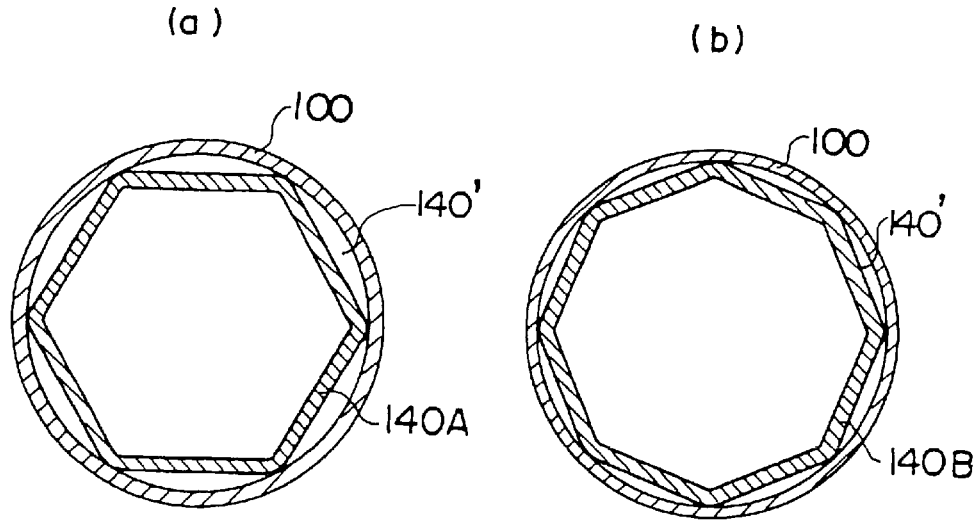
FIG. 3 is a cross-sectional view showing the main portion of another embodiment of the thermal expansion valve according to the present invention.

Moreover, according to the present thermal expansion valve, the design of the space 140' is not limited to the embodiment shown in FIG. 2, but other embodiments shown in FIG. 3 can also be applied. FIG. 3 is a cross-sectional view taken at the same position as FIG. 2, wherein the heat transmission retardant member 140 is polygonal. In FIG. 3(*a*), the member 140 is formed as a hexagon 140A, and in FIG. 3(*b*), the member is formed as an octagon 140B. By applying such polygonal shape, the corners of the polygon is positioned to contact the inner wall of the member 100, thereby forming the space 140'. According to the present embodiment where a polygonal heat transmission retardant member 140 is provided, the size of the space to be formed can be set freely according to the degree of hunting phenomenon, thus enabling to appropriately suppress hunting.

According to the embodiments explained above, the heat transmission retardant member made of cylinder-shaped resin is mounted to cover the full range of activated carbon 40 filled in the hollow portion 84, but according to the degree of hunting phenomenon, the heat transmission retardant member can be formed to cover only a portion of the activated carbon 40.

Further, the evaporator, the compressor, the condenser and the receiver constituting the refrigeration cycle are omitted from the drawing in the embodiment of FIG. 1. Reference 21' is a plug body made of stainless steel for sealing to an upper chamber 83 a predetermined refrigerant functioning as a temperature working fluid that drives the diaphragm 82, and it is welded to seal the hole 91*a* formed to the housing 91. Reference 74*a* is a push nut that prevents the movement of an o-ring mounted to a shaft 114 within a third hole 74, and 79 is a lid with a rising portion for pushing down the adsorbent such as the activated carbon placed inside the hollow portion of the heat-sensing driven member 100, which is press-fit to the hollow portion.

Figure 6:
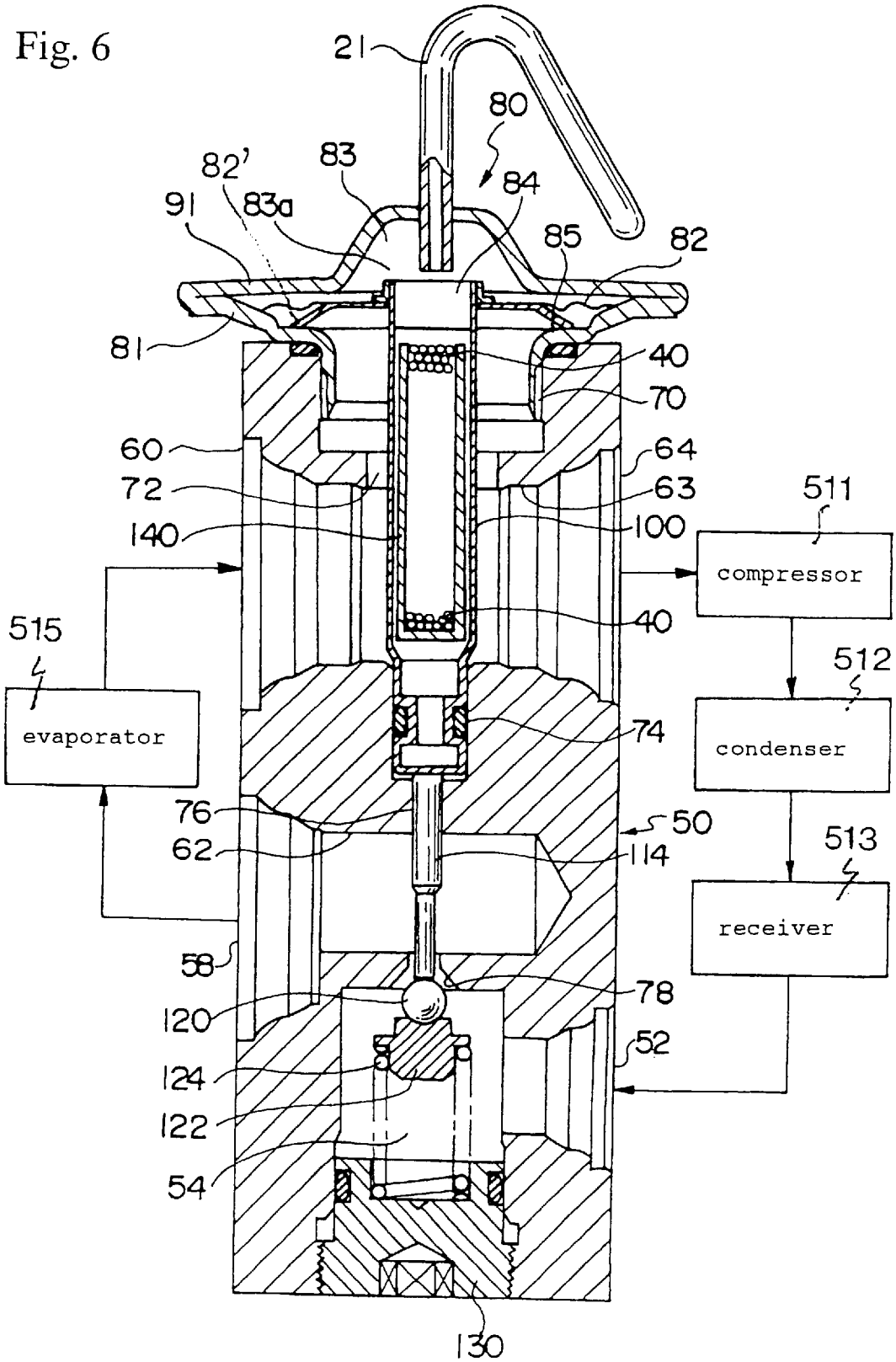
FIG. 6 is a vertical cross-sectional view showing another prior-art thermal expansion valve.

In the embodiment of FIG. 1, granular activated carbon is filled to the heat-sensing driven member 100 as the adsorbent 40. The carbon-filled driven member 100 and the diaphragm 82 are welded together as explained in FIG. 4, to form an integrated space 84 by the power element portion 80 and the heat-sensing driven member 100. The housing 91 defining this space 84 includes the plug body 21' that seals thereto the temperature-corresponding working fluid. However, instead of the plug body 21', a small pipe as shown in FIG. 6 can be used to degasify the space from one end of the pipe, and then to fill the working fluid to the space before sealing the end of the pipe.

Figure 4:
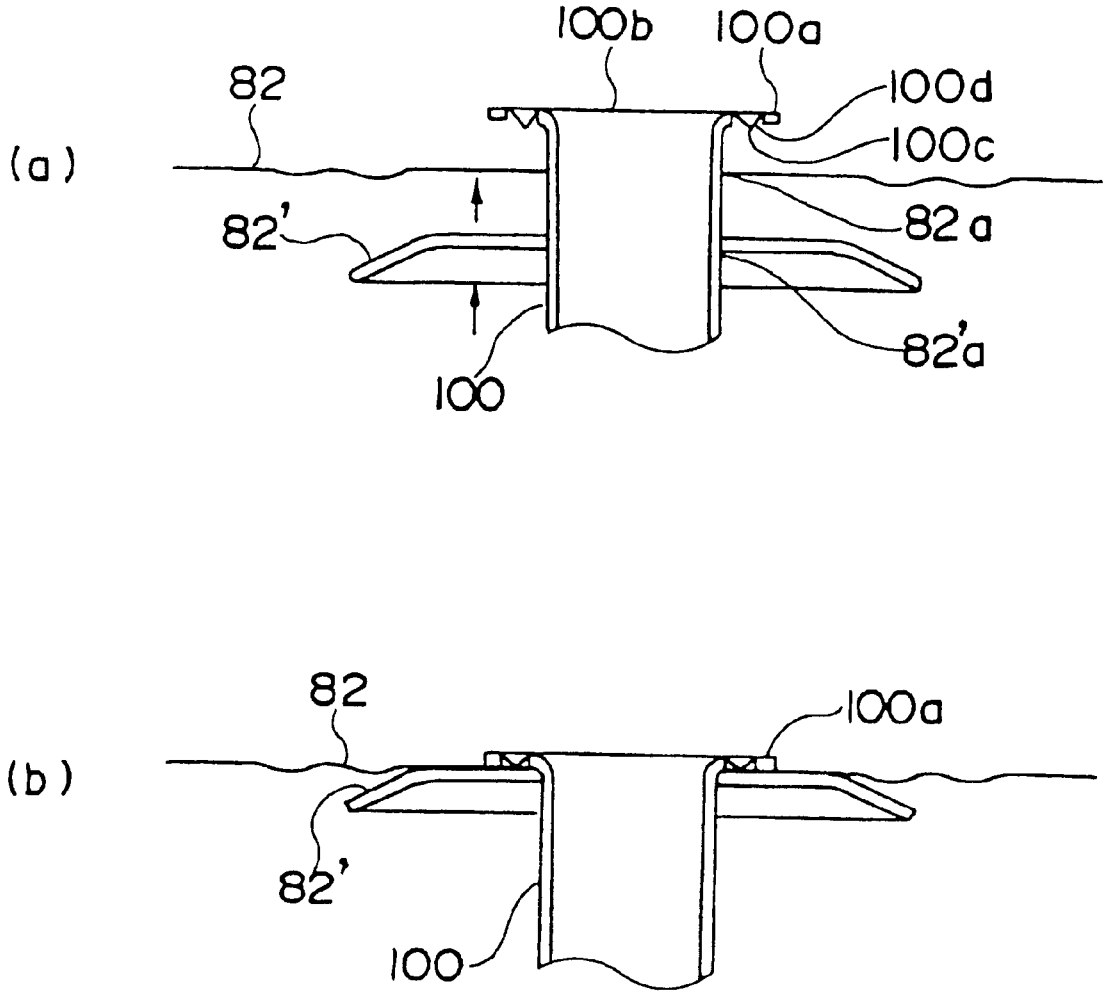
FIG. 4 is a drawing showing the structure of the main portion of the thermal expansion valve shown in FIG. 1.
Figure 5:
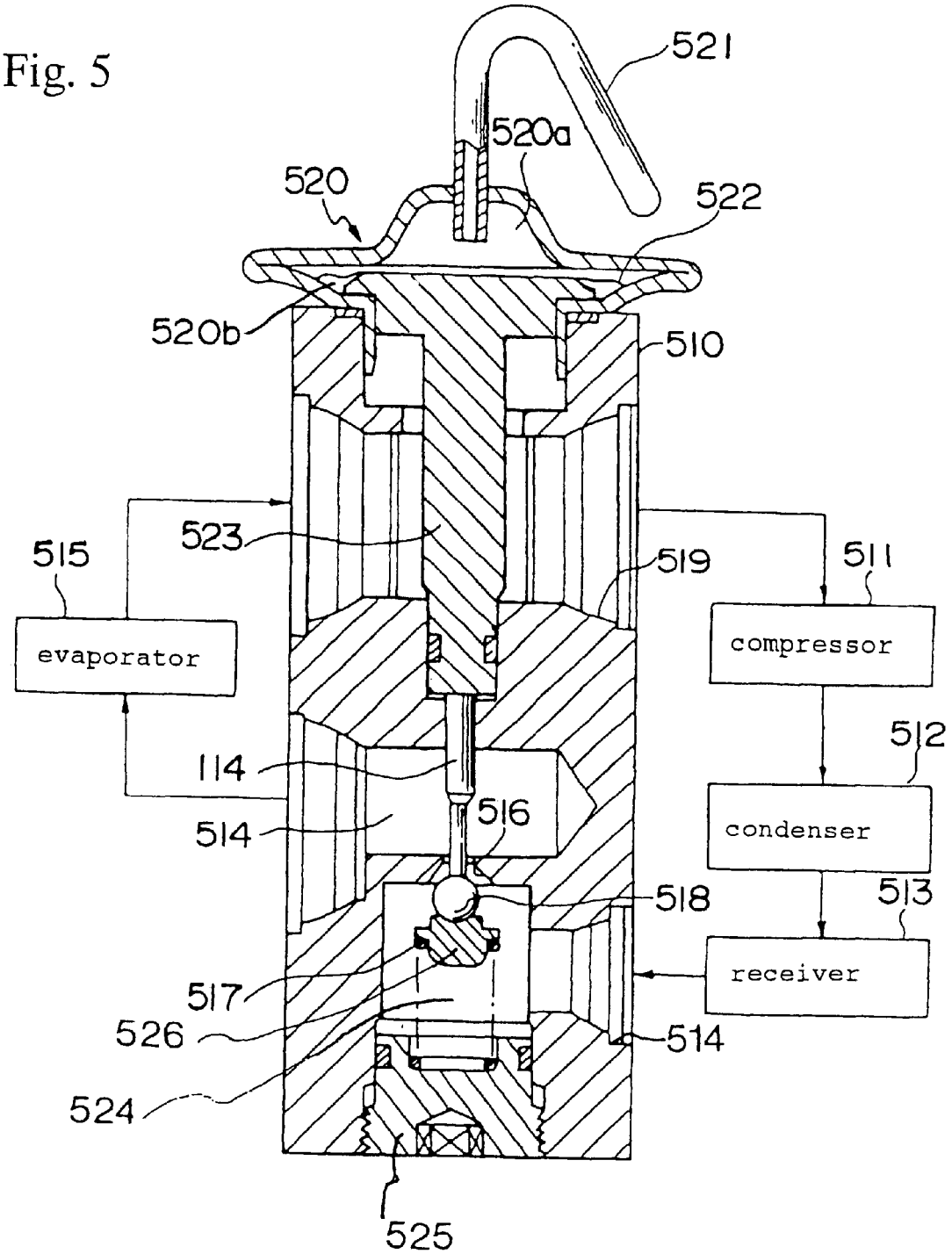
FIG. 5 is a vertical cross-sectional view showing the prior-art thermal expansion valve.

FIG. 4 shows the structure of the heat-sensing driven member 100, the diaphragm 82 and the support member 82' according to the embodiment of FIG. 1.

As shown in FIG. 4(*a*), a collar 100*a* is formed outside the opening 100*b* of the heat-sensing driven member 100, and to the collar 100*a* is formed a protrusion 100*c* and a groove 100*d* facing downward in the drawing. The protrusion 100*c* and the groove 100*d* are formed along the whole circumference of the collar 100*a*.

Further, a diaphragm 82 made for example of stainless steel material having an opening 82*a* formed to the center thereof is inserted via the opening 82*a* to the heat-sensing driven member 100 and moved in the direction of the arrow of FIG. 4(*a*) until it contacts the protrusion 100*c*. At this position, the diaphragm 82 is fixed to the heat-sensing driven member.

A support member 82' formed for example of stainless steel material for supporting the diaphragm 82 and having an opening 82' a formed concentrically with the opening 82*a* of the diaphragm 82 is inserted via the opening 82' a to the heat-sensing driven member 100 as diaphragm support member, and it is moved in the direction of the arrow of FIG. 4(*a*) until it contacts the diaphragm 82. Then, the protrusion 100*c* and the support member 82' are pressed together at upper and lower electrodes (not shown) so that the support member is concentrical with the protrusion 100*c*, before current is applied to these electrodes to perform a so-called projection welding. Thereby, as shown in FIG. 4(*b*), the collar 100*a*, the diaphragm 82 and the support member 82' are welded together.

As a result, the diaphragm 82 is welded onto the protrusion 100*c* between the collar 100*a* and the support member 82'. Further, the end portion of the diaphragm 82 is sandwiched between housings 81 and 91, and welded thereto.

As explained above, the thermal expansion valve according to the present invention includes a heat transmission retardant member mounted between a time constant retardant and the inner wall of the hollow portion of a heat-sensing driven member storing the time constant retardant, wherein a space is formed between the inner wall and the heat transmission retardant member. According to the invention, the temperature variation of the refrigerant is transmitted via the formed space and the heat transmission retardant member to the time constant retardant, so the hunting of the valve is effectively suppressed. Moreover, since the space can be formed to have a desired size according to the design of the heat transmission retardant member, the hunting of the valve can even further be suppressed effectively.

We claim:

1. A thermal expansion valve including a refrigerant passage extending from an evaporator to a compressor, and a heat-sensing driven member with a hollow portion formed to the interior thereof and having a heat sensing function positioned within said refrigerant passage:

wherein the end of said hollow portion of said heat-sensing driven member is fixed to the center opening portion of a diaphragm constituting a power element portion that drives said driven member, thereby communicating said hollow portion with an upper pressure chamber defined by said diaphragm within said power element portion and forming a sealed space filled with working fluid; and a heat transmission retardant member is placed between a time constant retardant stored within said hollow portion, and the inner wall of said hollow portion so that a space is formed between said inner wall and said heat transmission retardant member, the heat transmission retardant member having at least three points of contact as viewed in planar cross-section with the inner wall, the at least three points of contact arranged around the heat transmission retardant member such that the heat transmission retardant member is fixed centrally within the heat sensing driven member.

2. A thermal expansion valve according to claim 1, wherein said heat transmission retardant member is cylindrical.

3. A thermal expansion valve including a refrigerant passage extending from an evaporator to a compressor, and a heat-sensing driven member with a hollow portion formed to the interior thereof and having a heat sensing function positioned within said refrigerant passage:

wherein the end of said hollow portion of said heat-sensing driven member is fixed to the center opening portion of a diaphragm constituting a power element portion that drives said driven member, thereby communicating said hollow portion with an upper pressure chamber defined by said diaphragm within said power element portion and forming a sealed spade filled with working fluid; and a heat transmission retardant member is placed between a time constant retardant stored within said hollow portion and the inner wall of said hollow portion so that a space is formed between said inner wall and said heat transmission retardant member, wherein said heat transmission retardant member is cylindrical with protrusions that contact said inner wall.

4. A thermal expansion valve according to claim 1, wherein said heat transmission retardant member is formed to have a polygonal shape, the corners of which contact said inner wall.

5. A thermal expansion valve according to claim 1, wherein said heat transmission retardant member is a cylindrical member made of resin material.

6. A thermal expansion valve including a refrigerant passage extending from an evaporator to a compressor, and a heat-sensing driven member with a hollow portion formed to the interior thereof and having a heat sensing function positioned within said refrigerant passage:

wherein the end of said hollow portion of said heat-sensing driven member is fixed to the center opening portion of a diaphragm constituting a power element portion that drives said driven member, thereby communicating said hollow portion with an upper pressure chamber defined by said diaphragm within said power element portion and forming a sealed space filled with working fluid; and a heat transmission retardant member is placed between a time constant retardant stored within said hollow portion and the inner wall of said hollow portion so that a space is formed between said inner wall and said heat transmission retardant member, wherein said heat transmission retardant member is a cylindrical member made of resin material and having protrusions that contact said inner wall.

7. A thermal expansion valve according to claim 1, wherein said heat transmission retardant member is a polygonal shaped member made of resin material.

* * * * *